United States Patent [19]

Daley

[11] 4,144,608

[45] Mar. 20, 1979

[54] BOWLING PIN CLEANING APPARATUS

[76] Inventor: Earl W. Daley, 8222 E. Windsor Ave., Scottsdale, Ariz. 85257

[21] Appl. No.: 861,823

[22] Filed: Dec. 19, 1977

[51] Int. Cl.[2] ..... A63D 5/10

[52] U.S. Cl. ..... 15/97 R

[58] Field of Search ..... 15/21 R, 21 B, 21 C, 15/21 D, 97 R, 4

[56] References Cited

U.S. PATENT DOCUMENTS

| | | | |
|---|---|---|---|
| 2,746,069 | 5/1956 | Domenico | 15/4 |
| 2,907,059 | 10/1959 | Cornett | 15/21 R |
| 3,160,901 | 12/1964 | Cohen | 15/97 R X |
| 3,277,506 | 10/1966 | Congelli | 15/21 R X |

*Primary Examiner*—Edward L. Roberts

*Attorney, Agent, or Firm*—Don J. Flickinger; John A. Robertson

[57] ABSTRACT

A body has bottom, side and end elements which form a liquid containing vessel. Carried by the end elements, are a pair of opposed fixtures which support a bowling pin for horizontal axial alingnment. A flexible diaphram forms one wall of a fluid containing chamber carried by a cover member, which is hingedly affixed to the body. Extending over the diaphram is a scrubbing pad which is placed in juxtaposition with the bowling pin when the cover member is in the closed position. The scrubbing pad conforms to the contour of the rotating and wetted bowling pin in response to pressure of the fluid upon the diaphram.

4 Claims, 7 Drawing Figures

BOWLING PIN CLEANING APPARATUS

This invention relates to maintenance equipment useful in combination with sporting goods.

More particularly, the present invention concerns improved apparatus for cleaning bowling pins.

In a further aspect, the present invention concerns improved apparatus for automatically and mechanically wetting and cleaning a bowling pin.

Bowling is a common and popular avocational pursuit. Briefly, the game is usually played indoors on an elongate, wooden floor commonly referred to as a lane. Ten pins are placed triangularly at one end of the lane with a point of the arrangement, or single pin, facing a player at the other end of the lane. The player rolls a ball with sufficient force to traverse the lane in an attempt to topple the pins. Conventionally, a bowling pin is fabricated of maple wood and turned to a generally cylindrical shape. The surface of the pin is contoured, having a barrel shaped lower section, which graduates to a relatively thinner neck section. While the lower end of the pin is flat for resting upon a floor, the upper end is rounded.

Color and decoration is imparted by a plastic compound, usually applied in two coats. The structure is then encased in a nylon sock. Subsequently, the pin is finished with clear plastic. The flat bottom is untreated and includes a pilot hole for the turning operation.

The ability of a player to score a strike, topple all 10 pins with a single ball, or a spare by toppling all of the pins with two balls is dependent to a large extent upon the movement and action of the pins actually struck by the ball. Through use and time, bowling pins become soiled and dehydrated. As a result, in addition to being unsightly, the pin does not respond properly and is subject to splitting and breaking. Accordingly, maintenance procedures recommend periodic cleansing and restoration of prescribed moisture content.

In an attempt to improve over manual cleaning techniques, the prior art has devised mechanized bowling pin cleaning apparatus. Such devices generally incorporate a plurality of bristle brushes which are contoured to mate with the surface of a bowling pin. The bristles, which are placed either horizontal or vertical, rotate at a relatively high speed and require substantial motor force. One device utilizes a cam locking mechanism to hold the pin, while spring biasing means urge the brushes into contact with the pin. In accordance with another device, the pin is manually held by tongs and forced into a cluster of brushes rotating about fixed axes.

Certain inherent limitations have restricted the effectiveness and efficiency of prior art bowling pin cleaning machines. The contoured bristled brushes rapidly deteriorate, decreasing cleansing efficiency and requiring frequent replacement. Manually operated devices demand the total attention of an attendant who must postponse other tasks for the duration. Additional limitations and mechanical deficiencies, including rotating mass balance problems, bearing failures and cleaning fluid leaks, further limit the desirability of such machines. Also, such machines usually do not include provisions for restoring moisture to the pin, which procedure must be handled in a separate operation.

It would be highly advantageous therefore to remedy the deficiencies associated with the prior art.

Accordingly, it is an object of the present invention to provide an improved bowling pin cleaning apparatus.

Another object of the invention is the provision of an apparatus for the mechanized and automatic cleaning of bowling pins.

And another object of the invention is to provide an apparatus having stationary cleaning means which flexibly conform to the contour of a bowling pin.

Still another object of the invention is the provision of a bowling pin cleaning apparatus in which the bowling pin is held and rotated by mechanical means during the cleaning sequence.

Yet another object of the invention is to provide a bowling pin cleaning apparatus which is effective at relatively low rotational speeds, thereby having reduced power requirements and substantially eliminating dynamic balance considerations.

And yet another object of the invention is the provision of an apparatus which concurrently cleanses a bowling pin and restores moisture thereto.

Yet still another object of the present invention is to provide a bowling pin cleaning apparatus in which the cleaning element is readily changed or serviced as necessary.

A further object of the invention is the provision of a bowling pin cleaning apparatus in which the operative procedures are performed within an enclosed environment for purposes of safety and sanitation.

And a further object of the invention is to provide an apparatus which can accommodate more than one bowling pin at a time.

Still another object of the invention is the provision of a bowling pin cleaning apparatus which can be installed, operated and maintained without special skills, tools or provisions.

And still another object of the instant invention is to provide a bowling pin cleaning apparatus of the above type which is durably constructed, yet relatively inexpensively manufactured.

Briefly, to achieve the desired objectives of the instant invention in accordance with a preferred embodiment thereof, first provided in a body having a bottom with upstanding side and end members forming a liquid containing vessel. Carriage means carried by the body support a bowling pin for axial rotation, which is imparted by a drive means. Scrubbing means are also carried by the apparatus for contacting the surface of the bowling pin and conforming to the contour thereof. A portion of the bowling pin resides within cleansing liquid within the vessel, and, in response to rotation of the pin, liquid upon the surface of the pin is transferred to the scrubbing means.

In a more specific embodiment, the carriage means comprises a first fixture carried by one end wall of the body and a second fixture carried by the other end of the body. The first fixture includes a support bracket having a shaft rotatably journalled therein. One end of the shaft is rotatably driven by the drive means. The other end of the shaft includes connection means which drivingly engages the lower end of the bowling pin. The second fixture includes a support bracket carried by the other end of the housing. The support bracket rotatably carried an idler spindle having a socket formed in one end thereof, which receives the upper end of the bowling pin. Biasing means normally urge the socket into engagement with the pin. In a further embodiment, the apparatus includes a cover member which is hingedly affixed to the body. The cover member carries a fluid containing chamber having a flexible diaphragm forming a wall thereof. Scrubbing pad means extends over the diaphram and contacts the surface of the bowling pin when the cover member is in the closed position. The flexible diaphram and the scrubbing pad means conform to the contoured surface of the bowling pin in response to pressure exerted by the fluid within the fluid containing chamber.

The foregoing and further and more specific objects and advantages of the instant invention will become readily apparent to those skilled in the art from the following detailed description of preferred embodiments of the invention taken in conjunction with the drawings in which.

Figure 1:
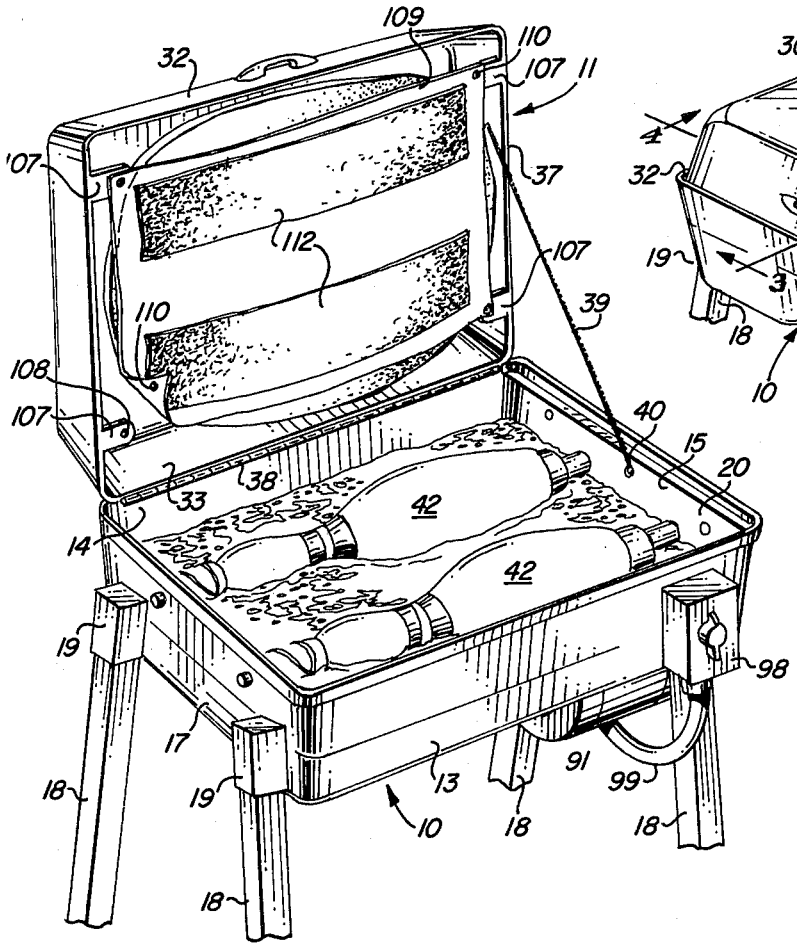
FIG. 1 is a partial perspective view of a bowling pin apparatus constructed in accordance with the teachings of the instant invention and shown with the cover member in the open position and two bowling pins placed therein for cleaning.

Turning now to the drawings, in which like reference characters indicate corresponding elements throughout the several views, attention is first directed to FIG. 1 which shows a bowling pin cleaning apparatus, embodying the principles of the instant invention, having a body member generally designated by the reference character 10 and a cover member generally designated 11. Body 10 includes a bottom 12, better seen in FIG. 3, with upstanding front and rear sides 13 and 14, respectively, and first and second ends 15 and 17, respectively. Body 10 is supported in an elevated position by legs 18 which are removably received in sockets 19, located at spaced positions about body 10.

Bottom 12, side 13, side 14, end 15 and end 17 have a continuous inner surface 20 and form a liquid containing vessel. A given quantity of liquid 22 for cleaning bowling pins is contained within the vessel. Further details of cleaning fluid 22, involving function within the apparatus of the instant invention, will be described presently. While the simplest of all cleaning fluids, water, will exhibit certain desirable characteristics of cleansing and moisture restoring, various commercially available solutions, especially prepared for the immediate purpose, will readily occur to those skilled in the art. Representative of such commercially available preparations is the product sold under the trade name of "Nu-Lac," a non-toxic, bio-degradable detergent, distributed by Atlas Products Company, DesMoines, Iowa.

Figure 4:
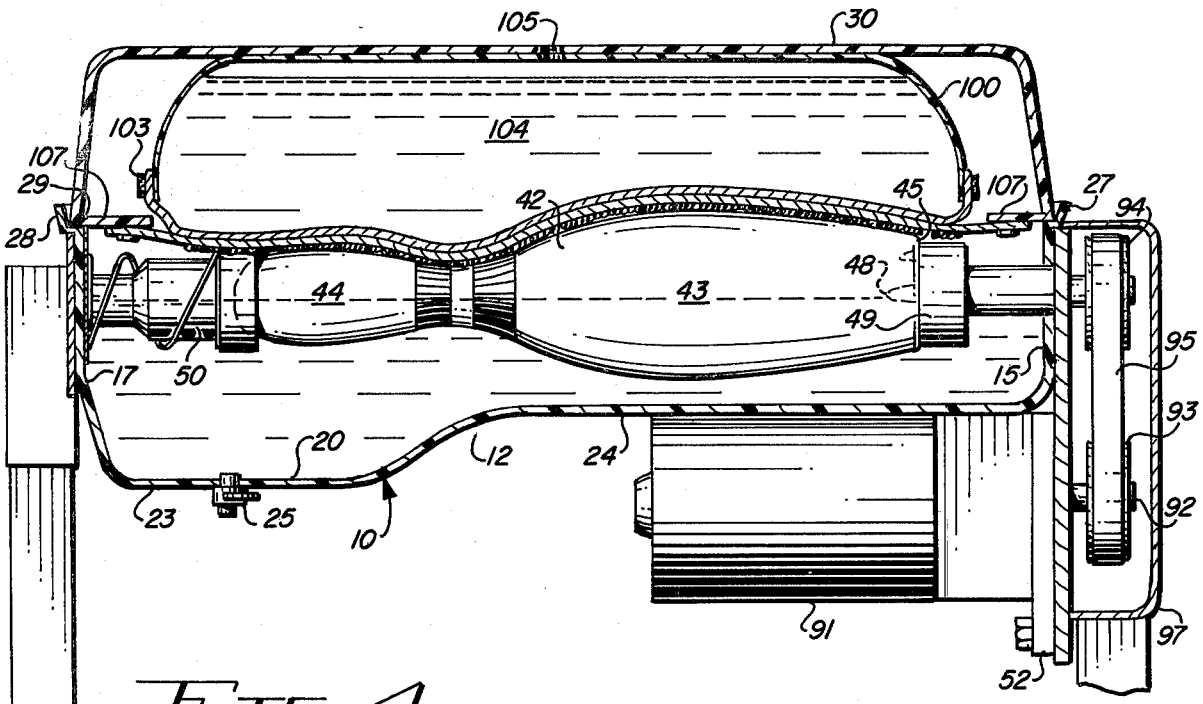
FIG. 4 is an enlarged vertical sectional view taken along the line 4—4 of FIG. 2.

Bottom 12, as best seen in FIG. 4, has a first section 23 and a second section 24. First section 23 is lowered and forms a sump near second end 17. Second section 24 slopes downwardly from first end 15 toward the sump formed by first section 23. Drain valve 25 is carried in first section 23 for obvious reasons. Body 10 further includes an upper peripheral edge 27 having an upwardly, outwardly directed lip 28 and a substantially horizontal shoulder 29.

Figure 2:
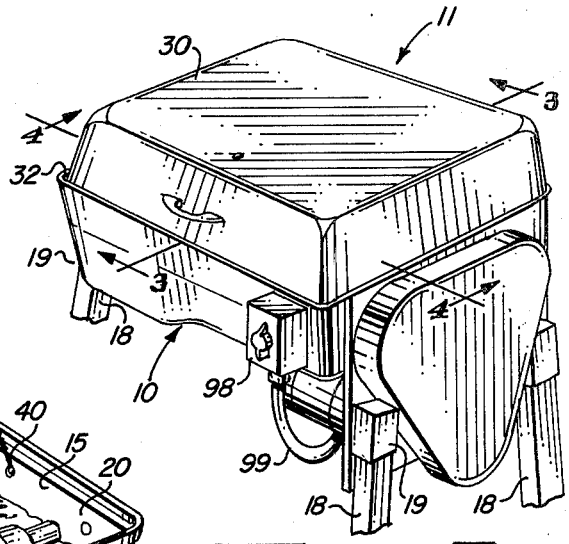
FIG. 2 is a partial perspective view of the bowling pin cleaning apparatus as in FIG. 1 and illustrating the cover member in the closed position.
Figure 3:
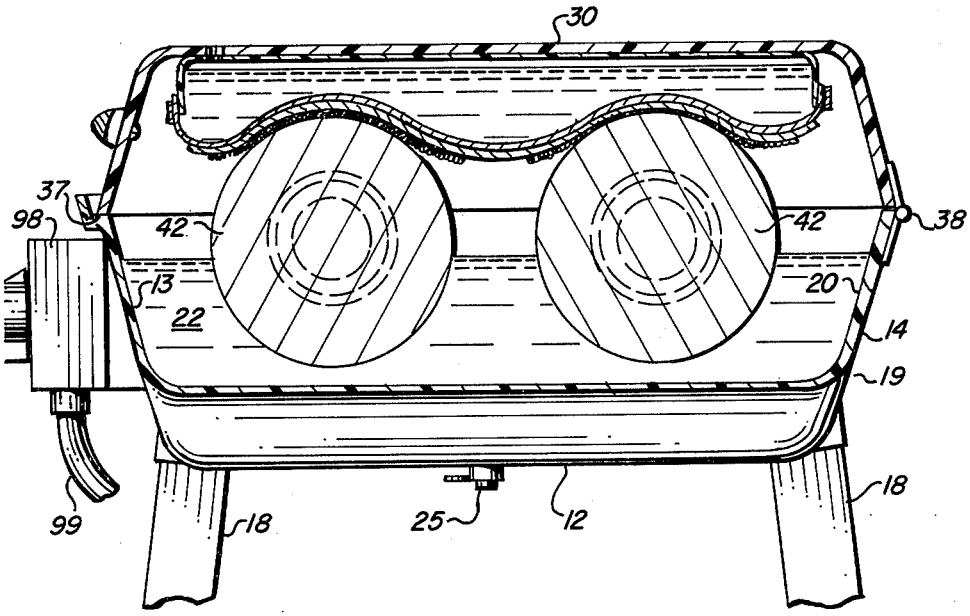
FIG. 3 is an enlarged vertical sectional view taken along the line 3—3 of FIG. 2.

Cover member 11 has a top 30 with depending front and rear sides 32 and 33, respectively, and first and second ends 34 and 35, respectively. The respective sides and ends of cover member 11 terminate with lower peripheral edge 37. The lower edge of rear side 33 is hingedly affixed to the upper edge of rear side 14 by hinge means 38. While various hinge structures will readily occur to those skilled in the art, hinge means 38 is specifically illustrated as a continuous hinge for purposes of strength. In the open position, as seen in FIG. 1, cover member 11 is retained in a substantially vertical position by chain 39, which is secured at respective ends to body 10 and cover member 11 by rivets 40, or other suitable fastening devices. In the closed position, as seen in FIG. 2, cover member 11 extends over body member 10 with lower peripheral edge 37 resting upon shoulder 29, as seen in FIGS. 3 and 4.

Typical bowling pins 42 are supported in a substantially horizontal position within body 10 by carriage means. Each bowling pin 42 has an enlarged lower section 43, which is somewhat barrel shaped, and is contoured into a reduced diameter neck section 44. Lower section 43 terminates with a flat base 45 upon which the pin normally rests during play. Neck section 44 terminates with a founded upper end 47. While pin 42 normally has an exterior surface finish, base 45 is unfinished, exposing the end grain of the wooden core. Pilot hole 48, which was useful during the manufacture of the pin, projects inwardly from base 45 along the longitudinal axis of pin 42.

The carriage means for supporting the two pins 42 comprises two pair of first and second fixtures 49 and 50, respectively. First fixtures 49 are carried by first end 15 of base 10, while second fixtures 50 are carried by second ends 17 of body member 10.

Figure 5:
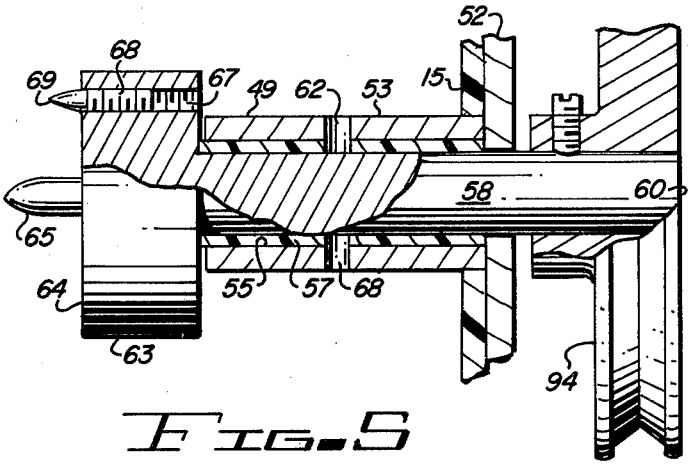
FIG. 5 is an enlarged elevation view partly broken of a fixture for supporting and drivingly rotating the lower end of a bowling pin as used in the invention of the previous Figures.

First fixture 49 is best described in connection with FIG. 5. Mounting plate 52 is secured to the external side of first end 15 by any suitable means, such as various adhesives or mechanical fasteners. It is understood that any mechanical fasteners extending through body 10 are sealed to prevent leaks of liquid 22. Two sockets 19 are carried by mounting plate 52, as well as drive means for fixture 49, as will be described presently.

First fixture 49 comprises a support bracket 53 which extends through an appropriately sized and shaped aperture 54 and is secured to mounting plate 52. Preferably, mounting plate 52 and support bracket 53 are metallic and are joined by welding in the conventional manner. Support bracket 53 has bore 55 extending therethrough, in which resides anti-friction bearing 57. Shaft 58, having inner end 59 and outer end 60, is rotatably journaled within bearing 57. Passage 62 extends transversely through support bracket 53 and anti-friction bearing 57. Passage 62 provides for splash lubrication of bearing 57 and shaft 58 by liquid 22. As bowling pin 42 is rotated, as will be described presently, a certain amount of splash is created within liquid 22 and randomly a portion of the splash will strike support bracket 53 and enter passage 62. Preferably, anti-friction bearing 57 is fabricated of Teflon, nylon, bronze or other suitable material.

Coupling means are carried at the inner end of shaft 58 for driving engagement with lower end 45 of bowling pin 42. The coupling means, in accordance with the instant embodiment, is in the form of a flange 63, having a radial surface 64 against which base 45 is placed. Pilot pin 65 extends from surface 64 in axial alignment with shaft 58 and is received within pilot hole 48 of pin 42. Threaded aperture 67 extends through flange 63 parallel to and spaced from pilot pin 65. Externally threaded set screw 68, having pointed end 69, is matingly received within threaded aperture 67. Screw 68 functions as a driving pin which engages base 45. Screw 68 randomly engages pin 42 with point 69 being imbedded into base 45 sufficient for driving engagement. Screw 68 is helically movable within aperture 67 to adjust the penetration depth of point 69 in base 45. Screw 68 is adjustable to compensate for wear or resharpening of point 69. It is not anticipated that screw 68 need be moved as a part of the normal operational procedure.

Figure 6:
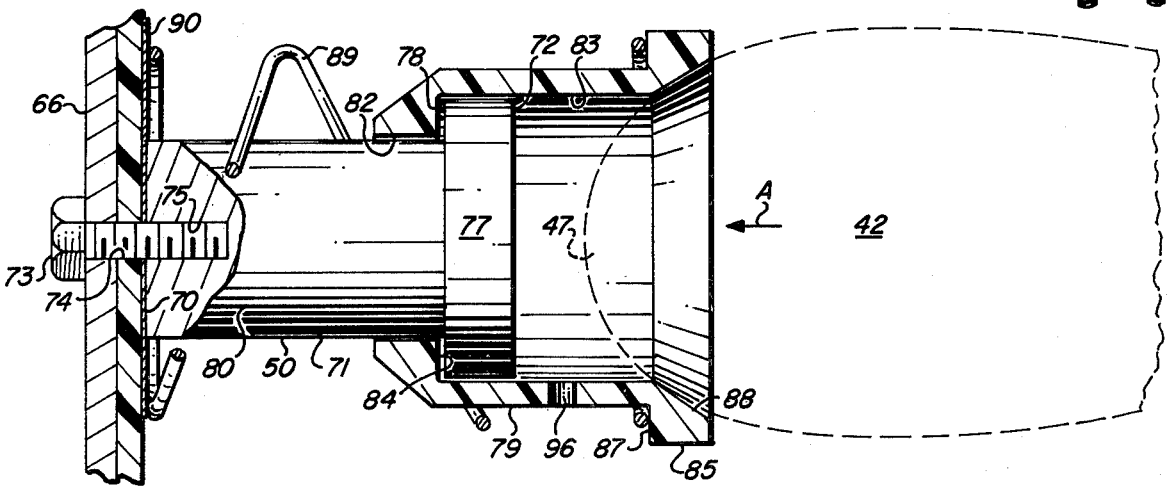
FIG. 6 is an enlarged elevation view partly broken of another fixture useful in connection with the instant invention and especially constructed for supporting the upper end of a bowling pin.

Second fixture 50 is best illustrated in FIG. 6. A second mounting plate 66 is secured to the exterior side of second end 17 in a manner similar to the securment of first mounting plate 52 to first end 15. Two sockets 19 are secured to mounting plate 66. Support bracket 71 has a first end 70 directed toward first end 17 of body member 10 and a free end 72. Bolt 73 passes through aperture 74 in mounting plate 66 and second end 17, and threadedly engages aperture 75 in support bracket 71. Proximate free end 72 of support bracket 71, is an enlarged section 77 which forms annular shoulder 78 which faces second end 17. Spindle 79 is rotatably and slideably carried by support bracket 69. Cylindrical section 80 of support bracket 69 is received within bore 82 of spindle 79 and enlarged section 77 resides within counterbore 83. Annular shoulder 84, extending between bore 82 and counterbore 83, abuts shoulder 78 when socket 79 is urged in a direction away from second end 17.

Free end 85 of spindle 79 is enlarged and includes shoulder 87 and socket 88. Socket 88 resides beyond free end 72 of support bracket 71 and is shaped to receive the rounded upper end 47 of bowling pin 42. Coil spring 89 encircles mounting bracket 69 and spindle 79 and has respective ends thereof bearing against shoulder 87 and second end 17. Reinforcing plate 90 is clamped between second end 17 of body member 10 and first end 70 of support bracket 69 has a bearing pad for one end of spring 89. Spring 89 normally urges socket 88 in a direction toward first fixture 49. It is understood that the axis of rotation of the elements of first fixture 49 is aligned with the axis of rotation of the elements of second fixture 50.

Bowling pin 42 is readily and conveniently engaged with fixtures 49 and 50. Upper end 47 of bowling pin 42 is angularly inserted into socket 88 with sufficient pressure in the direction of arrow A to slightly compress spring 89 and move spindle 79 in a direction away from first fixture 49, during which fluids trapped in socket 88 are discharged through vent 96. Pin 42 is then brought into axial alignment with fixtures 49 and 50 and moved toward first fixture 49 with pilot pin 65 entering pilot hole 48. Subsequently, spring 89 urges based 45 against radial surface 64 and imbedding pointed end 69 into pin 42. Removal of pin 42 is a reverse of the foregoing described procedure.

The drive means for urging rotation of the bowling pin carriage comprises a conventional reduction motor 91 secured to mounting plate 52 in accordance with conventional practice, and having a drive shaft 92 extending through mounting plate 52. Drive pulley 93 is secured to shaft 92 by key, set screw, or other well known means. Driven pulley 94 is similarly affixed to outer end 60 of shaft 58. As illustrated, pulleys 93 and 94 are conventional V-belt pulleys. V-belt 95 encircles pulleys 92 and 94 and transmits driving torque from motor 91 to shaft 58. Although not herein specifically illustrated, it will be understood by those skilled in the art that a second driven pulley 94 is associated with the other fixture 49, as seen in FIG. 1, and that belt 95 is continuous over the three pulleys. Cover member 97 encloses pulley 93, the several pulleys 94 and belt 95 for purposes of safety.

As seen in FIGS. 1–3, a conventional timing mechanism 98 is secured to front side 13. Motor 91 is a conventional electrical motor, and in accordance with standard practice is controlled by timing mechanism 98 through wiring within electrical conduit 99. In accordance with laboratory tests, it has been determined that a motor 91 developing approximately one-sixth horsepower and rotating pin 42 at 135 revolutions per minute is adequate for the immediate purpose. Similarly, it has been found that a 1 to 5 minute duration will yield satisfactory results. Accordingly, timing mechanism 98 is of the commercially available type having a rotating knob which can be turned to the proper setting of a minute indicating scale and when released will begin to count down to zero, and automatically discontinue electric service to motor 91.

Scrubbing means for bowling pin 42 is carried by cover member 11, as illustrated in FIGS. 1, 3 and 4. A fluid containing chamber is formed by a continuous side wall 100 depending from top 30 and flexible diaphram 102 secured to continuous wall 100 and forming a wall of the fluid chamber. Flexible diaphram 102 overlaps continuous wall 100 and is secured thereto by band 103. In the immediate embodiment, a liquid such as water 104 provides the fluid medium within the chamber, which is vented to the atmosphere through hole 105 extending through top 30. Hole 105 is placed near front side 32 to prevent escape of liquid when cover member 11 is in the open position. The pressure of water 104 against diaphram 102 causes diaphram 102 to conform to the contour of bowling pin 42 when cover member 11 is in the closed position. It will be appreciated by those skilled in the art that other liquids will provide the desired hydraulic effect. It will also be appreciated that a gas receiving valve can be placed in hole 105 and diaphram 102 urged against bowling pin 42 in response to pneumatic pressure.

A plurality of spaced ears 107 extend inwardly from peripheral edge 37 of cover member 11. Each ear 107 carries one-half of a snap engagement pair, such as twist lock 108. A flexible sheet 109, such as can be fabricated from various plastics or heavy cloth, extends over diaphram 102 and has appropriately spaced elements, herein shown as apertures 110 for engagement with the elements carried by ears 107. A pair of spaced scrubbing pads 112 are carried by flexible sheet 109 and arranged to contact pins 42 when cover member 11 is in the closed position. Scrubbing pads 112 are readily fabricated from a variety of natural materials, such as wool, or synthetic materials, such as fiberous or cellular plastic.

As pins 42 are supported by fixtures 49 and 50, at least a portion thereof resides within cleaning liquid 22. During rotation, the surface of pins 42 is wetted and the cleansing liquid is carried upwardly to scrubbing pads 112. The combination of the cleansing liquid and scrubbing pad 112 bearing against pin 42 satisfactory cleanses the surface of pin 42, without deterioration of the surface finish. During the cleaning operation, liquid 22 enters through base 45 and restores moisture to pin 42. In response to the movement during the cleaning operation, sufficient liquid is delivered to passage 62 for lubrication purposes.

Figure 7:
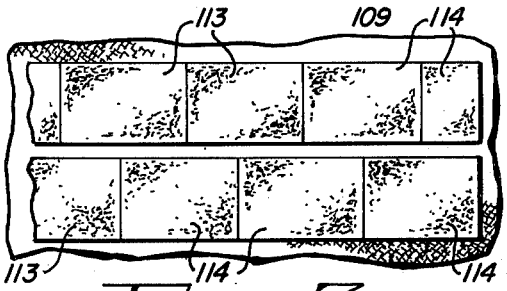
FIG. 7 is a plan view of a fragmentary section of an alternate scrubbing pad means useful in connection with the instant invention.

FIG. 1 illustrates a single continuous pad for each pin 42. FIG. 7 shows an alternate embodiment thereof, wherein a pair of spaced pads 113, each having segmented sections 114, operate upon each pin 42.

Various changes and modifications to the embodiments herein chosen for purposes of illustration will readily occur to those skilled in the art. For example, while there is shown in the drawings an embodiment which accommodates two bowling pins, embodiments may be readily fabricated to receive one or a larger plurality of simultaneous pins. Also, while the biasing feature is specifically illustrated in combination with the second fixture, it is appropriate that the inner end or the first fixture could be made movable and incorporate the biasing means. Various materials of construction are further anticipated. It is generally preferred that the body member and the cover member be fabricated of a high impact plastic, such as that commonly referred to as ABS. Other plastic and metallic material will readily occur to those skilled in the art having regard for the foregoing disclosure. To the extent that such modifications and variations do not depart from the spirit of the invention, they are intended to be included within the scope thereof which is limited only by a fair interpretation of the appended claims.

Having fully described and disclosed by present invention and alternately preferred embodiments thereof in such clear and concise terms as to enable those skilled in the art to understand and practice the same, the invention claimed is:

1. An apparatus for holding a bowling pin, which pin includes a generally cylindrical body having a contoured surface and normally upper and lower ends, and for holding a quantity of liquid and for cleaning said bowling pin, said apparatus comprising:

(a) a body having a bottom with upstanding front and rear sides and upstanding first and second ends and having an upper peripheral edge,
said bottom, sides and ends forming a liquid retaining vessel;

(b) carriage means carried by said body for supporting said bowling pin and for axially rotating said bowling pin;

(c) drive means for urging rotation of said carriage means;

(d) scrubbing means carried by said apparatus for contacting the surface of said bowling pin and conforming to the contour thereof;

(e) a cover member hingedly affixed to said body and movable between a first position extending over and spaced above said bowling pin supported by said carriage means and a second position in which said bowling pin is removable from said carriage means;

(f) a fluid containing chamber carried by said cover member;

(g) a diaphram forming a wall of said chamber and residing in juxtaposition with said bowling pin when said cover member is in said first position, said diaphram being sufficiently flexible to conform to the contoured surface in response to pressure exerted by said fluid; and (h) scrubbing pad means extending over said diaphram for contact with the surface of said bowling pin.

2. The apparatus of claim 1, wherein said scrubbing pad means is detachably securable to said cover means.

3. The apparatus of claim 1, further including fluid transfer means for the entrance and removal of fluid in said chamber.

4. The apparatus of claim 3, further including stop means for holding said cover member substantially upright in said second position and wherein said fluid transfer means includes an air vent proximate the upper portion of said chamber when said cover member is in said second position.

* * * * *